US009629484B2

(12) United States Patent
Brozak

(10) Patent No.: US 9,629,484 B2
(45) Date of Patent: Apr. 25, 2017

(54) GREETING CARD ENDCAP PANEL KIT

(71) Applicant: American Greetings Corporation, Cleveland, OH (US)

(72) Inventor: Emory Brozak, Strongsville, OH (US)

(73) Assignee: American Greetings Corporation

( * ) Notice: Subject to any disclaimer, the term of this patent is extended or adjusted under 35 U.S.C. 154(b) by 202 days.

(21) Appl. No.: 14/456,836

(22) Filed: Aug. 11, 2014

(65) Prior Publication Data

US 2016/0037943 A1 Feb. 11, 2016

(51) Int. Cl.

| | |
|---|---|
| ***A47F 7/00*** | (2006.01) |
| ***A47F 5/00*** | (2006.01) |
| ***A47F 5/10*** | (2006.01) |

(52) U.S. Cl.

CPC ..... *A47F 7/0014* (2013.01); *A47F 5/0018* (2013.01); *A47F 5/101* (2013.01); *A47F 5/103* (2013.01)

(58) Field of Classification Search

CPC ..... A47F 7/145; A47F 7/147; A47F 7/144; A47F 7/146; A47F 7/163; A47F 7/17; A47F 7/0014; A47F 5/0025; A47F 5/0068; A47F 5/0807; A47F 5/08; A47F 5/0846; A47F 5/0869; A47F 5/0018; A47F 5/101; A47F 5/103; A47F 1/12

USPC ..... 211/50, 51, 55

See application file for complete search history.

(56) References Cited

U.S. PATENT DOCUMENTS

| | | | | |
|---|---|---|---|---|
| 5,346,166 | A | 9/1994 | Valiulis | |
| 5,472,103 | A * | 12/1995 | Merl | A47B 47/022 211/187 |
| 5,938,048 | A * | 8/1999 | Carroll | A47F 7/145 211/55 |
| 5,957,422 | A | 9/1999 | Shea | |
| 6,951,290 | B2 | 10/2005 | Speed | |
| 7,100,878 | B2 | 9/2006 | Shea | |
| 7,219,459 | B2 | 5/2007 | Valiulis et al. | |
| 7,641,061 | B1 | 1/2010 | Cuzzocrea | |
| 7,775,379 | B2 * | 8/2010 | Hodge | A47F 5/0846 100/108 |
| 8,042,700 | B1 | 10/2011 | Smalley | |
| 8,919,579 | B2 * | 12/2014 | Weigand | A47F 7/144 211/186 |
| 8,991,624 | B2 * | 3/2015 | Brozak | A47F 5/0025 211/85.26 |
| 2004/0074855 | A1 * | 4/2004 | Wons | A47F 7/145 211/55 |

(Continued)

*Primary Examiner* — Patrick Hawn

(74) *Attorney, Agent, or Firm* — Christine Flanagan

(57) ABSTRACT

An end cap display panel which can be attached to a larger fixture alongside an end cap display shelf. The end cap panel display attaches directly to a slotted upright of the larger display and shares the pre-existing slots on the vertical upright with the shelf attachment mechanism so that the shelves can be attached, removed or reconfigured without interference from the end cap display panel. The end cap display panel also provides a plurality of trays which can be snap-fit together to form various display configurations for retaining and displaying a plurality of groups of identical greeting cards. The display takes advantage of previously unutilized space while providing a robust, flexible, modular option for the display of greeting cards or other merchandise alongside end cap shelving.

9 Claims, 9 Drawing Sheets

(56) References Cited

U.S. PATENT DOCUMENTS

| | | | | |
|---|---|---|---|---|
| 2004/0140276 | A1* | 7/2004 | Waldron | A47F 7/145 211/51 |
| 2007/0170126 | A1* | 7/2007 | Singer | A47F 7/145 211/55 |
| 2008/0078728 | A1* | 4/2008 | Hodge | A47F 7/144 211/55 |
| 2010/0282697 | A1* | 11/2010 | Weigand | A47F 7/144 211/50 |
| 2011/0226775 | A1 | 9/2011 | Shea | |
| 2011/0297630 | A1* | 12/2011 | O'Day | A47F 7/163 211/59.2 |
| 2012/0318759 | A1* | 12/2012 | Buettner | A47F 7/147 211/55 |
| 2013/0015148 | A1 | 1/2013 | Valiulis | |

* cited by examiner

GREETING CARD ENDCAP PANEL KIT

RELATED APPLICATIONS

There are no applications related to this application.

FIELD OF THE INVENTION

The present invention is in the field of display fixtures of the type used in a retail location. More specifically, this invention is directed to a flexible end cap panel kit which is attachable to the sides of an end cap display.

BACKGROUND OF THE INVENTION

In today's market, retail floor space is at a premium. Product vendors try to display and sell as much merchandise as possible and must be increasingly creative in the marketing and display of products such that they maximize the amount of merchandise displayed at a particular retailer but also minimize the amount of space required for the display of said merchandise. Space requirements and aisle configurations often differ considerably not only from retailer to retailer but also from department to department. Vendors and retailers must also be concerned with the neatness of product displays and the amount of aisle space retained for consumers to easily navigate through the store.

End cap displays are found at the end of long shelving fixtures, also known as gondolas. Product displayed on an end cap is sometimes called a feature because the end cap helps to display items but also to sell products. End caps are typically arranged into three vertical sections—a top section for signage and/or messaging, a middle or core section showcases a feature product and the bottom section is for holding additional stock. Oftentimes product displayed on an end cap display is not associated with products which are contained and displayed in the aisles adjacent to said end cap. Retailers and vendors are constantly looking to devise new display fixtures and methods of displaying merchandise so that more merchandise can be displayed in prime retail locations, such as end cap displays or displays located adjacent to the cash wrap or register, where consumers are most tempted to make what is referred to as an impulse purchase.

There currently exists display apparatus which allows for the display and marketing of merchandise at such coveted retail locations. For example, there are many support fixtures which are operable to attach onto already existing fixtures, and which can support small or lightweight items such as gift cards, or small items with cardboard backing that can be suspended from various hooks or clips. U.S. Pat. No. 5,957,422 describes a strip display for small merchandise which can be suspended from an existing display via a supporting bracket, such that merchandise hangs therefrom in a vertical manner. U.S. Pat. No. 7,219,459 discloses a sign holder and strip assembly which attaches to a shelf, the strip assembly containing plastic hooks thereon for displaying lightweight merchandise. U.S. Patent Publication No. 2013-0015148 describes a merchandise strip having a supporting member which is inserted onto the side of an existing display or shelf and a strip member which contains a plurality of clips used for suspending items therefrom. U.S. Pat. No. 5,346,166 describes a heavy duty hanger assembly for hanging merchandise in front of a horizontal shelf. The assembly is mounted directly on the shelf via a plate and vertically supports plastic merchandiser hooks. U.S. Pat. No. 7,641,061 describes a vertical strip display system having a vertical wire grid which may support a variety of merchandise display holders.

More robust display apparatus which have the ability to retain slightly heavier weight products attach directly to an end cap shelf to provide greater support for the products contained thereon. U.S. Pat. No. 8,042,700 describes one such display apparatus having a shelf which attaches directly to a supporting wall of an end cap via a connector strip. U.S. Pat. No. 7,100,878 describes an extender bracket which is attached directly to an upright display panel of a larger merchandising display. The extender bracket extends out into an aisle via a support arm with an S-hook attached thereto for suspending merchandise therefrom. U.S. Patent Publication No. 2011-0226775 discloses a merchandise display system having a wire-form structure which supports wire-framed baskets for holding merchandise. The wire structure attaches directly to an upright of a larger display fixture, such as a gondola.

The current retail merchandise displays lack sufficient flexibility, size and/or strength to neatly contain and display a plurality of groups of front facing greeting cards along the sides of an end cap display. Most of the strip-type assemblies are too flimsy or do not have the capacity to hold several different groups of greeting cards in a manner which keeps the greeting cards neat but also provides enough visibility of each different greeting card grouping. Heavier wire-form displays often require attachment directly to an end cap display shelf or one or more vertical uprights of a gondola. This is problematic because end cap merchandise turns over very quickly, which may require the frequent attachment and detachment of various types and number of shelves to hold the merchandise earmarked for the end cap. There is a need in the field for a strong, flexible display which can be attached near or alongside end cap display shelves without interfering with the frequent attachment, removal and reconfiguration of said display shelves. There is also a need for a particular device which has the ability to contain and display a plurality of groups of greeting cards which are displayed in a front-facing manner and which allow complete or substantial visibility of the front face of the groups of greeting cards.

SUMMARY OF THE INVENTION

The present disclosure and related inventions solve the above-mentioned retail display difficulties by providing an end cap display panel which can be attached to a larger fixture alongside an end cap display shelf The end cap panel display of the present invention attaches directly to a slotted upright of the larger display and shares the pre-existing slots on the vertical upright with the shelf attachment mechanism so that the shelves can be attached, removed or reconfigured without interference from the end cap display panel. The end cap display panel also provides a plurality of trays which can be snap-fit together to form various display configurations for retaining and displaying a plurality of groups of identical greeting cards. The display takes advantage of previously unutilized space while providing a robust, flexible, modular option for the display of greeting cards or other merchandise alongside end cap shelving.

DETAILED DESCRIPTION OF PREFERRED AND ALTERNATE EMBODIMENTS

The end cap panel kit of the present disclosure and related inventions provides a modular kit for utilizing display space alongside horizontal shelving, such as at the end of an aisle or an end cap. The kit includes a plurality of panel trays, mounting panel brackets and optional sign clips and divider clips. The end cap panel can be built without the use of tools and is easy to assemble, disassemble or reconfigure. The plurality of panel trays can be snap-fit together to form a vertical assembly of between one and six trays high on each side of a display or end cap shelf.

Figure 3:
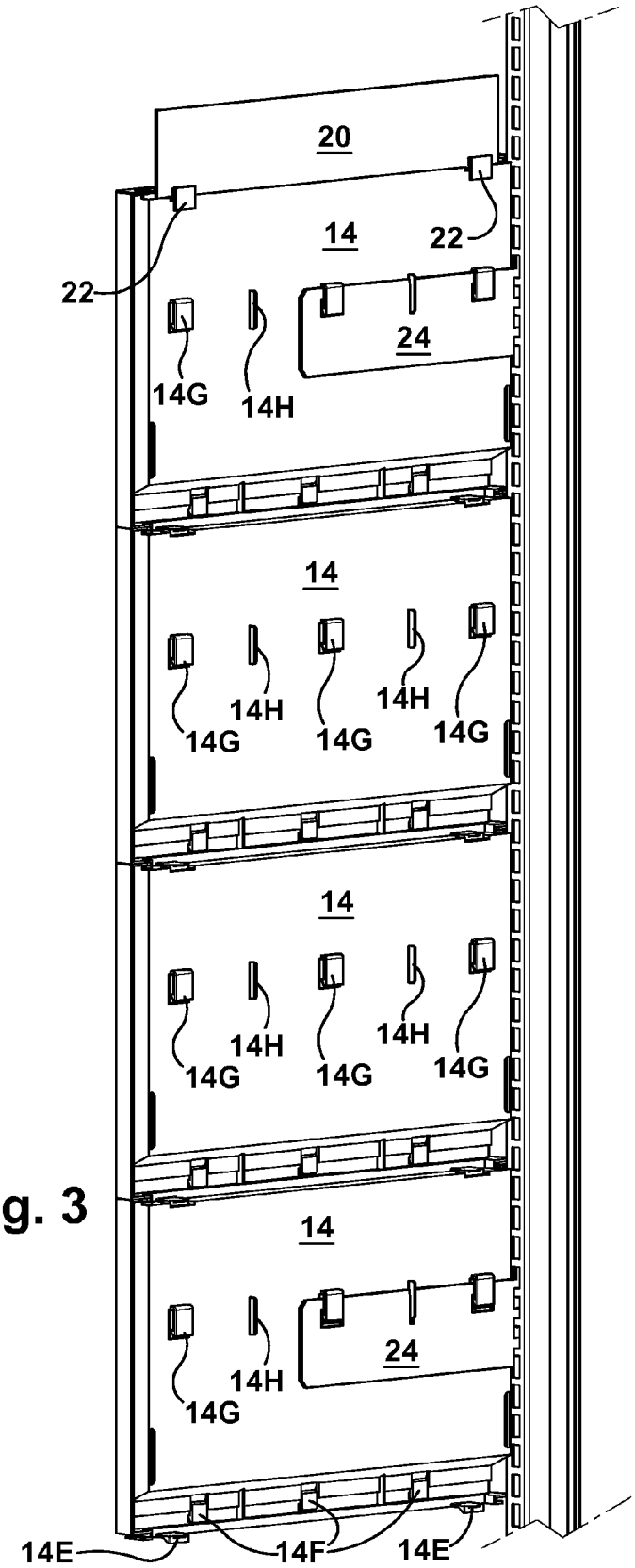
FIG. 3 is a perspective view of the inside surface of the GREETING CARD END CAP PANEL of FIG. 1.
Figure 4:
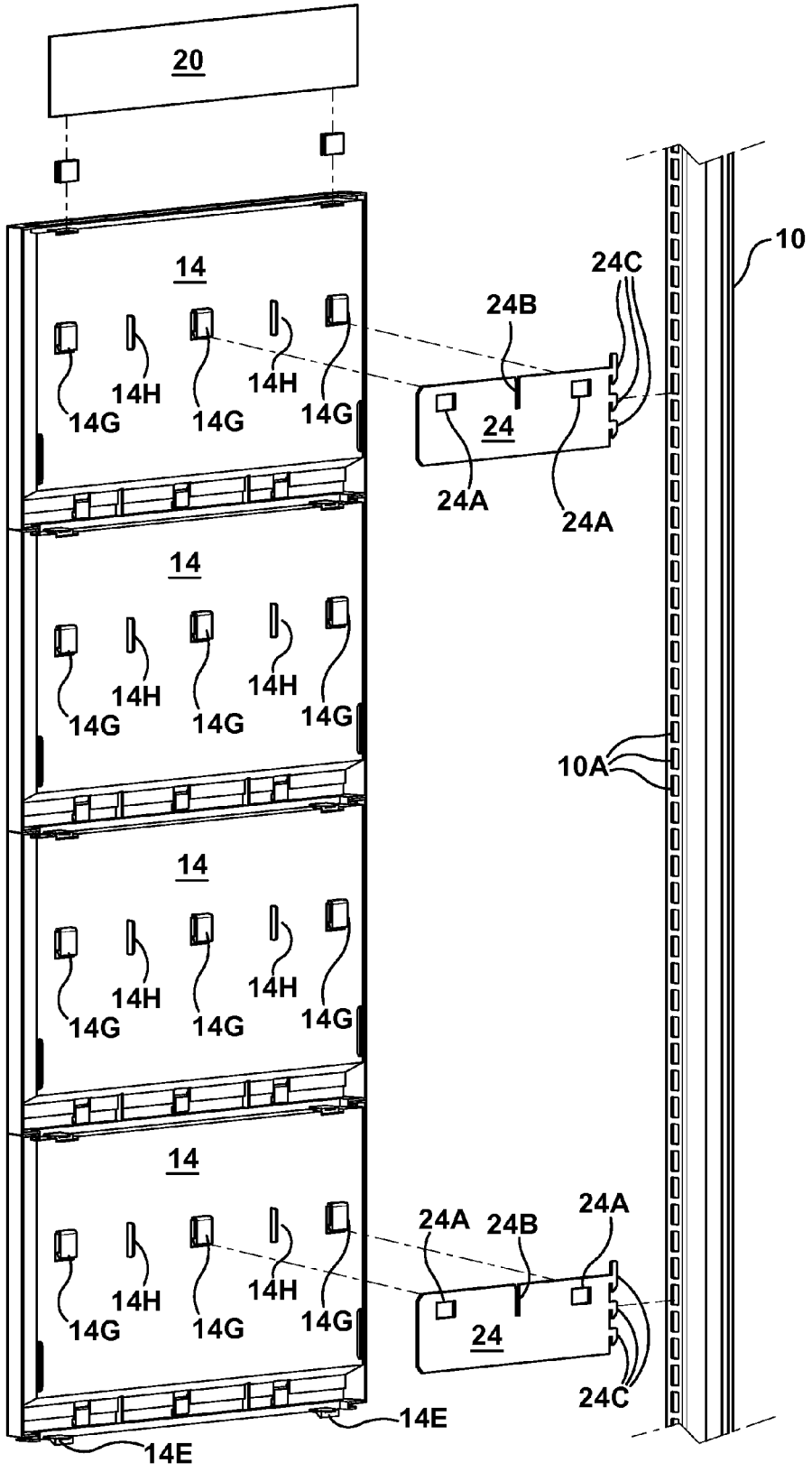
FIG. 4 is an exploded view of FIG. 3.

The panel trays 14, as shown in detail in FIGS. 3 and 4, are substantially rectangular-shaped trays which contain a front surface and a rear surface, opposite the front surface thereof. The trays 14 also contain two (2) side panels 14A, 14B and a floor panel 14C which extend perpendicularly outward from the inside surface of the panel tray 14. Each panel tray 14 also contains a variety of tabs, slots and projections thereon. These tabs, slots and projections are used to attach the panel trays 14 to one another, to a mounting panel bracket 24, to sign clips 22 and divider clips, and to attach a pocket front 16 to each panel tray 14. Each panel tray 14 can be attached to two (2) other panel trays 14, one along an upper horizontal edge and another along a lower horizontal edge thereof. To facilitate a snap-fit engagement between two (2) panel trays 14, each panel tray 14 contains two horizontal openings or slots (referred to hereafter as "panel engagement slots") 14D at opposing ends of the upper horizontal edge of each panel tray 14. These panel engagement slots 14D are used to attach two (2) panel trays 14 together by inserting the two (2) outward projections (referred to hereafter as "panel engagement projections") 14E located at opposing ends of the lower horizontal edge of each panel tray 14 into the two panel engagement slots 14D. The two (2) panel engagement projections 14E each contain a lip. When the panel engagement projections 14E of a first tray are snapped into the panel engagement slots 14D of a second tray, the lip catches on the lower surface of the panel engagement slot, preventing disengagement of the two (2) trays 14. When two (2) or more trays 14 are attached together, the unused panel engagement slots 14D of the uppermost tray 14 can be used to accommodate sign clips 22, as shown in FIG. 4. Based on the typical height of a larger display fixture, such as a gondola, up to six (6) panel trays 14 can be attached together to form the end cap card panel 100 of the present invention. Fewer trays can be used when fewer items of merchandise are available or necessary.

Figure 2:
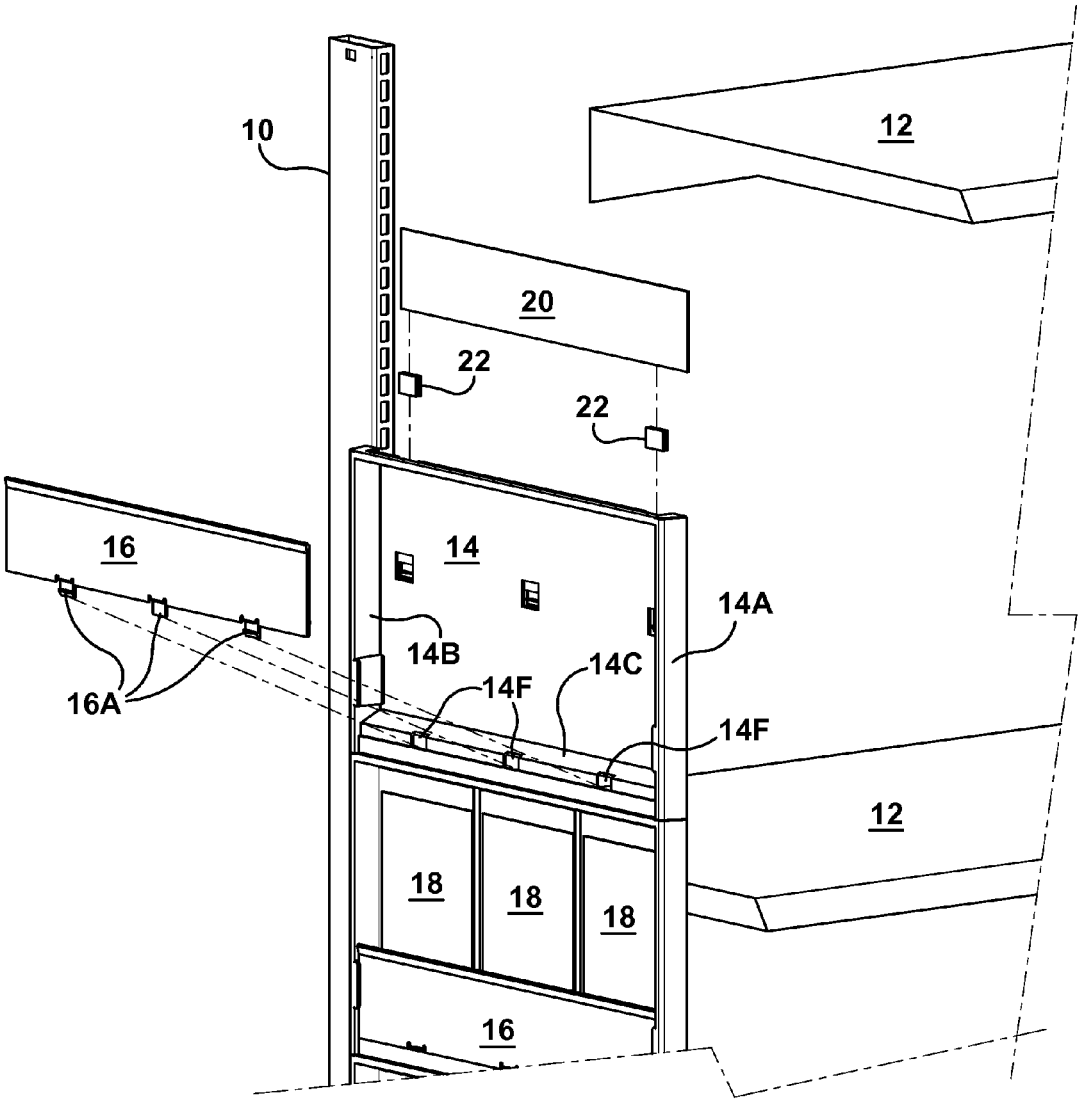
FIG. 2 is a perspective view of a card tray and pocket front of the GREETING CARD END CAP PANEL of FIG. 1.

Each panel tray 14 also contains three (3) evenly spaced openings (hereinafter referred to as "front pocket engagement slots") 14F along the lower horizontal edge of the tray (slightly above vertically and horizontally between the two (2) panel engagement projections 14E). The three (3) front pocket engagement slots 14F accommodate the insertion of three (3) front pocket panel projections 16A located proximate to the lower horizontal edge of each front pocket panel 16, as shown in FIG. 2. Similar to the tray panel engagement projections 14E, the front pocket panel projections 16A contain a lip thereon for ensuring secure engagement of the front pocket panel 16 to the tray panel 14. Together, the engaged tray panel 14 and front pocket panel 16, form a greeting card pocket which may accommodate a plurality of greeting cards 18 placed therein. Each front pocket panel 16 is approximately eighteen (18) inches wide, three and one-half (3.5) inches tall (up to four (4) inches tall including front pocket panel projections 16A), and approximately 0.2 inches thick. In a preferred embodiment, the front pocket panel 16 is made of a clear or transparent material, such as for example, plastic, so that the full front face of the groups greeting cards contained therein are visible.

Each tray panel 14 further includes three (3) mounting bracket engagement tabs 14G and two (2) mounting bracket securement projections 14H. The mounting bracket engagement tabs 14G are evenly spaced across an upper section of the tray panel 14, slightly above an imaginary horizontal bisection line. Each mounting bracket engagement tab 14G contains a lip which extends outward from the outer surface of the tray 14 and facilitates secure engagement of the tray panel 14 to a mounting bracket 24. The two mounting bracket securement projections, also extend slightly outward from the outer surface of each panel tray 14 with a first projection 14H located between the first and second mounting bracket engagement slots 14G and a second projection 14H located between the second mounting bracket engagement slots 14G. Both devices 14G, 14H enable the secure attachment of a panel tray 14 to a mounting bracket 24. Each mounting bracket 24 is a substantially planar bracket having two mounting bracket engagement slots 24A and one mounting bracket securement channel 24B contained thereon. Each mounting bracket 24 further contains three (3) upright engagement 24C tabs located on one (1) vertical edge for engagement with a slotted upright 10, as shown in FIG. 4.

Figure 6:
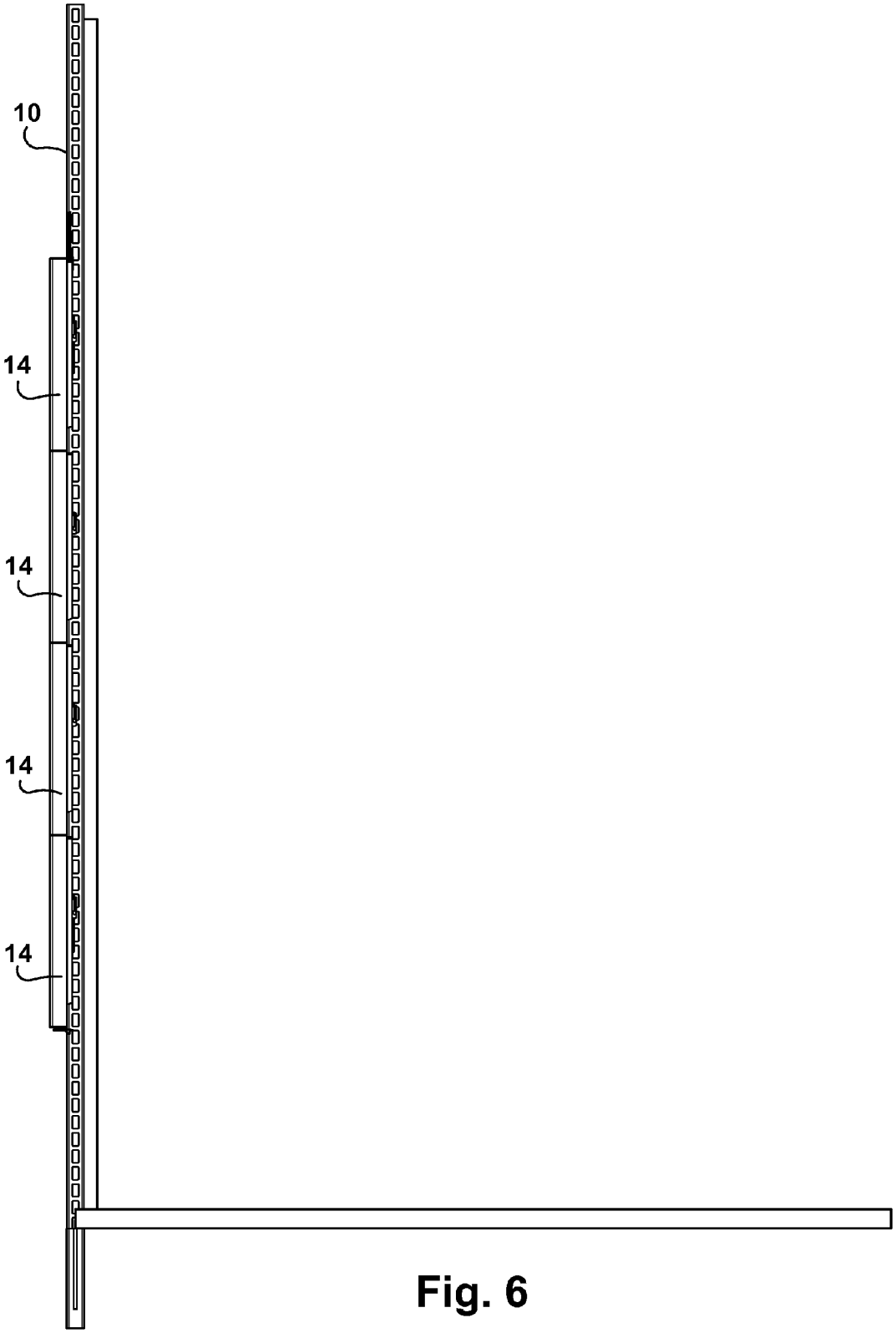
FIG. 6 is a front view of the GREETING CARD END CAP PANEL of FIG. 1, from the front of the end cap.
Figure 7:
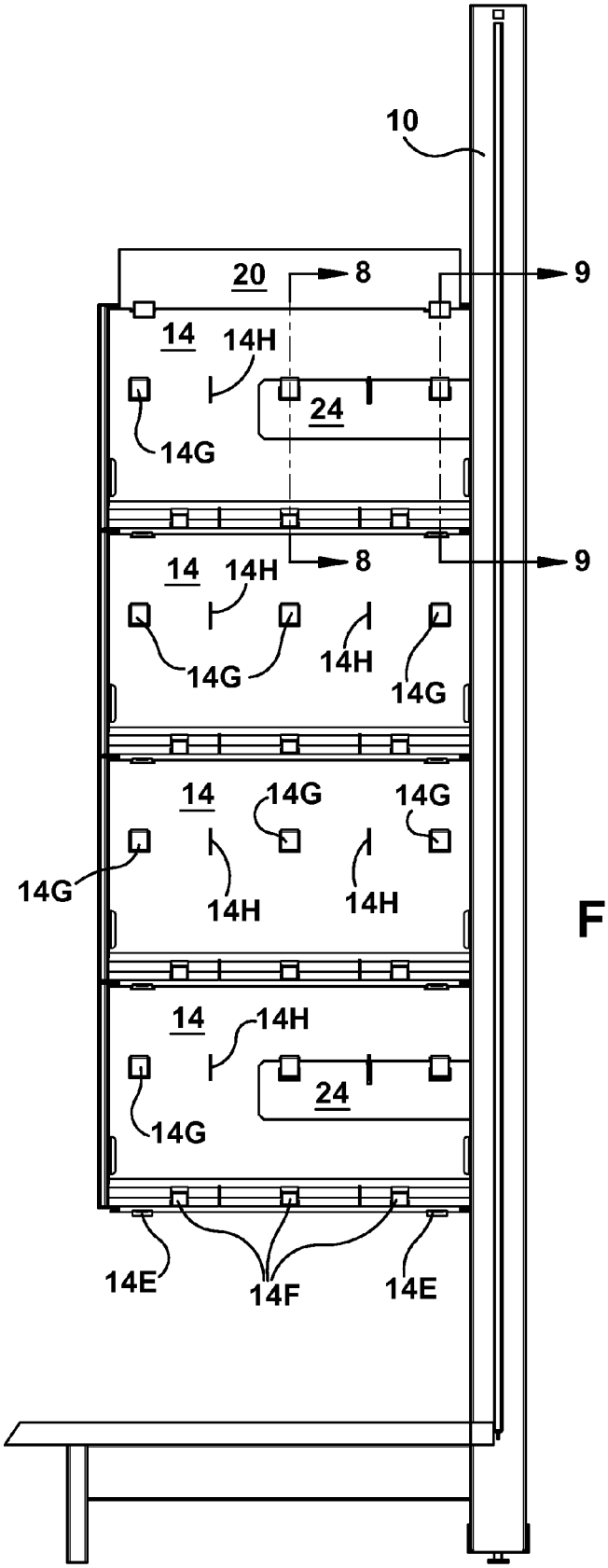
FIG. 7 is a front view of the GREETING CARD END CAP PANEL of FIG. 1, from the right side of the end cap.
Figure 8:
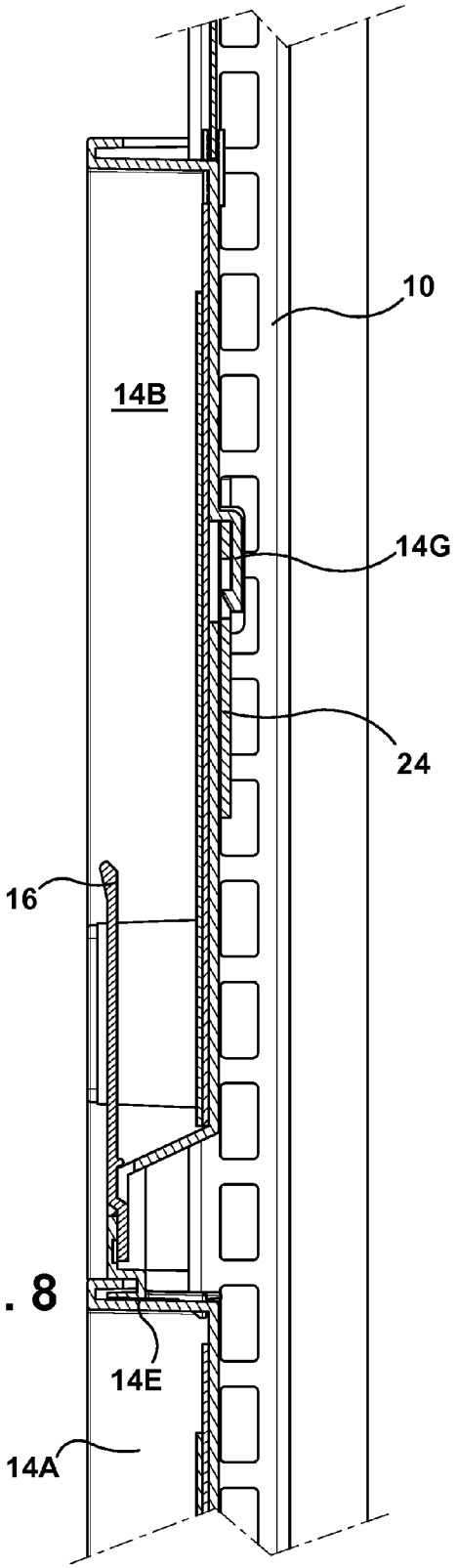
FIG. 8 is a cross-sectional view of the GREETING CARD END CAP PANEL of FIG. 7, from the direction of arrows 8-8.
Figure 9:
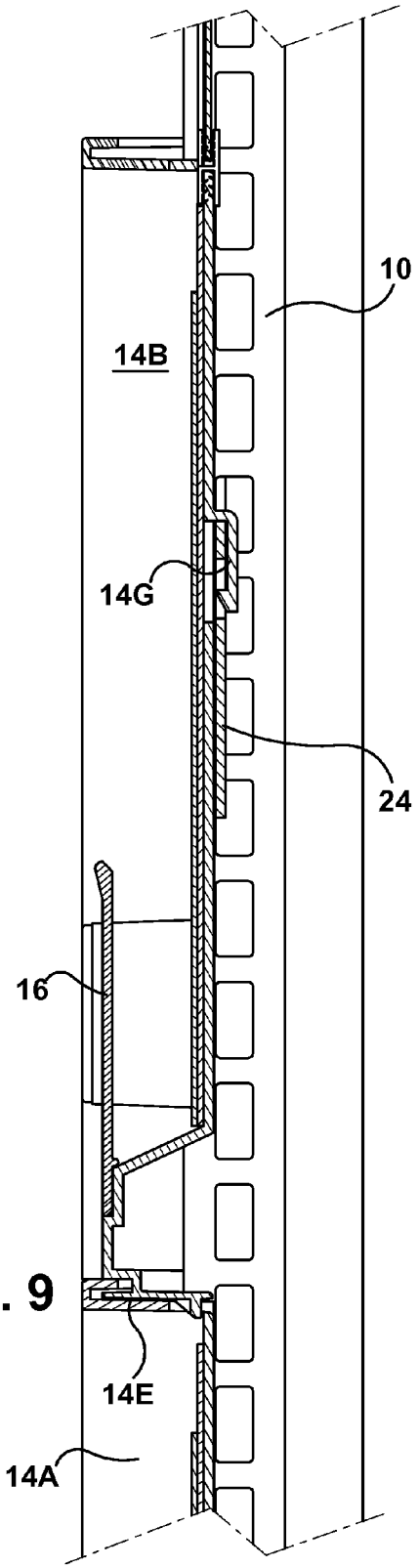
FIG. 9 is a cross-sectional view of the GREETING CARD END CAP PANEL of FIG. 7, from the direction of arrows 9-9.
Figure 10:
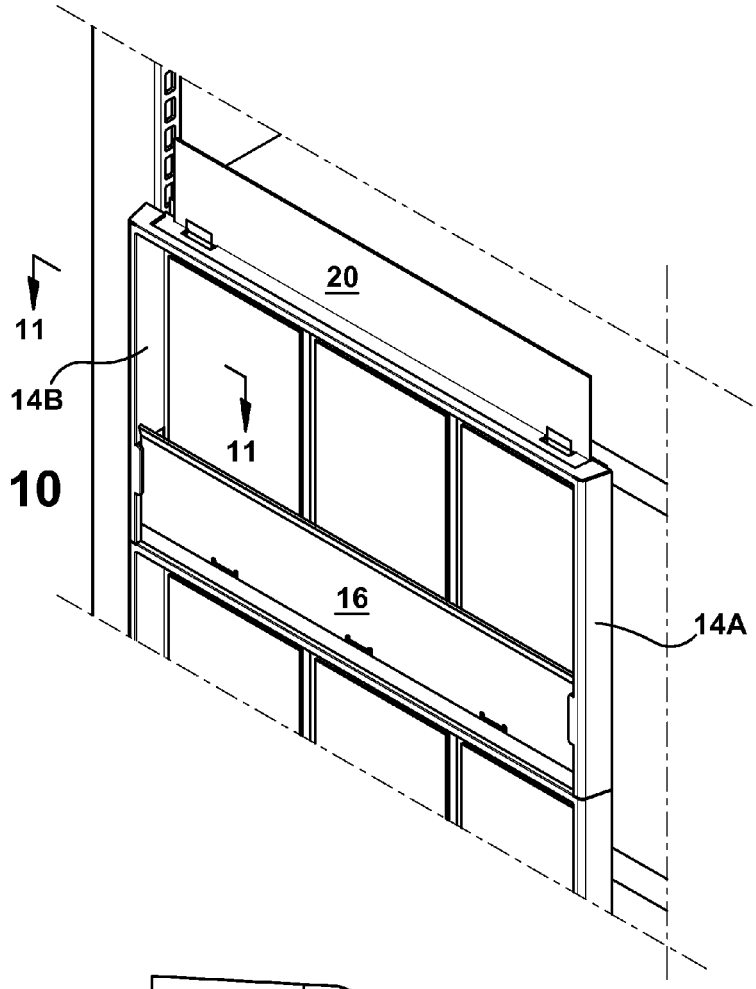
FIG. 10 is partial perspective view of the GREETING CARD END CAP PANEL of FIG. 1.
Figure 11:
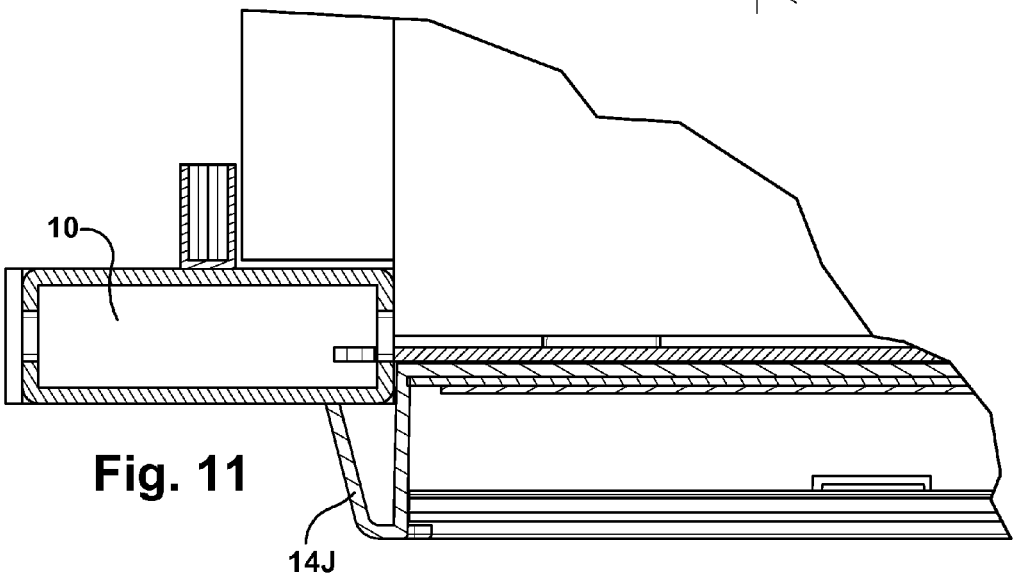
FIG. 11 is a top down view of the GREETING CARD END CAP PANEL of FIG. 10 from the direction of arrows 11-11.

For attachment of the tray panel 14 to the mounting bracket 24, two (2) mounting bracket engagement tabs 14G located on the panel tray 14 are inserted into the two (2) mounting bracket engagement slots 24A located on the mounting bracket 24. Also, one (1) of the mounting bracket securement projections 14H located on the panel tray 14 is inserted into the mounting bracket securement channel 24B, located on the mounting bracket 24, as shown in FIGS. 3, 7, 8 and 9. In operation, since the openings in the mounting bracket engagement tabs 14G on the panel tray 14 are facing downward, the mounting bracket 24 can be slid in an upward direction, such that the mounting bracket engagement slots 24A are inserted into the mounting bracket engagement tabs 14G and the mounting bracket securement projection 14H is inserted into the mounting bracket securement channel 24B. Each mounting bracket is approximately eleven (11) inches wide and approximately three (3) inches tall (up to approximately 3.5 inches including upright engagement tabs 24C) There are three (3) mounting bracket engagement tabs 14G but only two (2) mounting bracket securement slots 24A so that the same panel tray 14 can be used for attachment to a slotted upright 10 (via the mounting bracket 24) on both the left and right sides of the shelf or display. When the mounting bracket 24 is attached to the slotted upright 10, the display extends outward, perpendicular to the end cap, alongside any shelving attached to the end cap, as shown in FIG. 6. To secure the mounting bracket 24 to a slotted upright 10, the three (3) upright engagement tabs 24C on one edge of the mounting bracket 24 are inserted into three (3) upright engagement slots 10A on the slotted upright 10. The insertion of the mounting bracket 24 into the slotted upright 10 does not interfere with the attachment, removal, or reconfiguration of shelves also attached to the slotted upright 10 because the three (3) upright engagement tabs 24C can share space in each slot 10A with the end cap shelves or other attached display device. Shelves can be removed from or attached to the same slots 10A on the upright 10 that are being utilized by the end cap display panel 100. This is a vast improvement over the prior art because prior display devices were attached directly to a shelf, in which case, if a shelf needed to be removed, the display device would need to be removed as well and reattached to another shelf Other prior art solutions that were not attached directly to a shelf, were attached to the slotted upright. In this case, the prior art display device could not share slots with a shelf or other display device, thereby causing the display to be removed and reattached if and when product displayed on the end cap required a different type of shelving or a different number or configuration of shelves. Also, each panel tray 14 contains a slight projection 14J at each end which allows an edge of the panel tray 14 to extend slightly along the outside of the slotted upright 10 such that the slotted upright 10 is sandwiched between the panel tray 14 and the mounting bracket, as shown in FIGS. 10 and 11. This configuration prevents the end cap panel 100 from swinging outward away from the shelf and into the aisle.

In a preferred embodiment, each panel tray 14 is approximately nineteen (19) inches wide, approximately twelve (12) inches high and approximately one and one-half (1.5) inches thick. All sizes herein have been determined based on the standard greeting card size as well as the standard height and width of an end cap shelf display. However, it has been contemplated that the end cap panel of the present invention may be attached to other types of retail displays and therefore may be adapted as such. Alternative sizes have been contemplated and are considered to be within the scope of the present invention.

Figure 1:
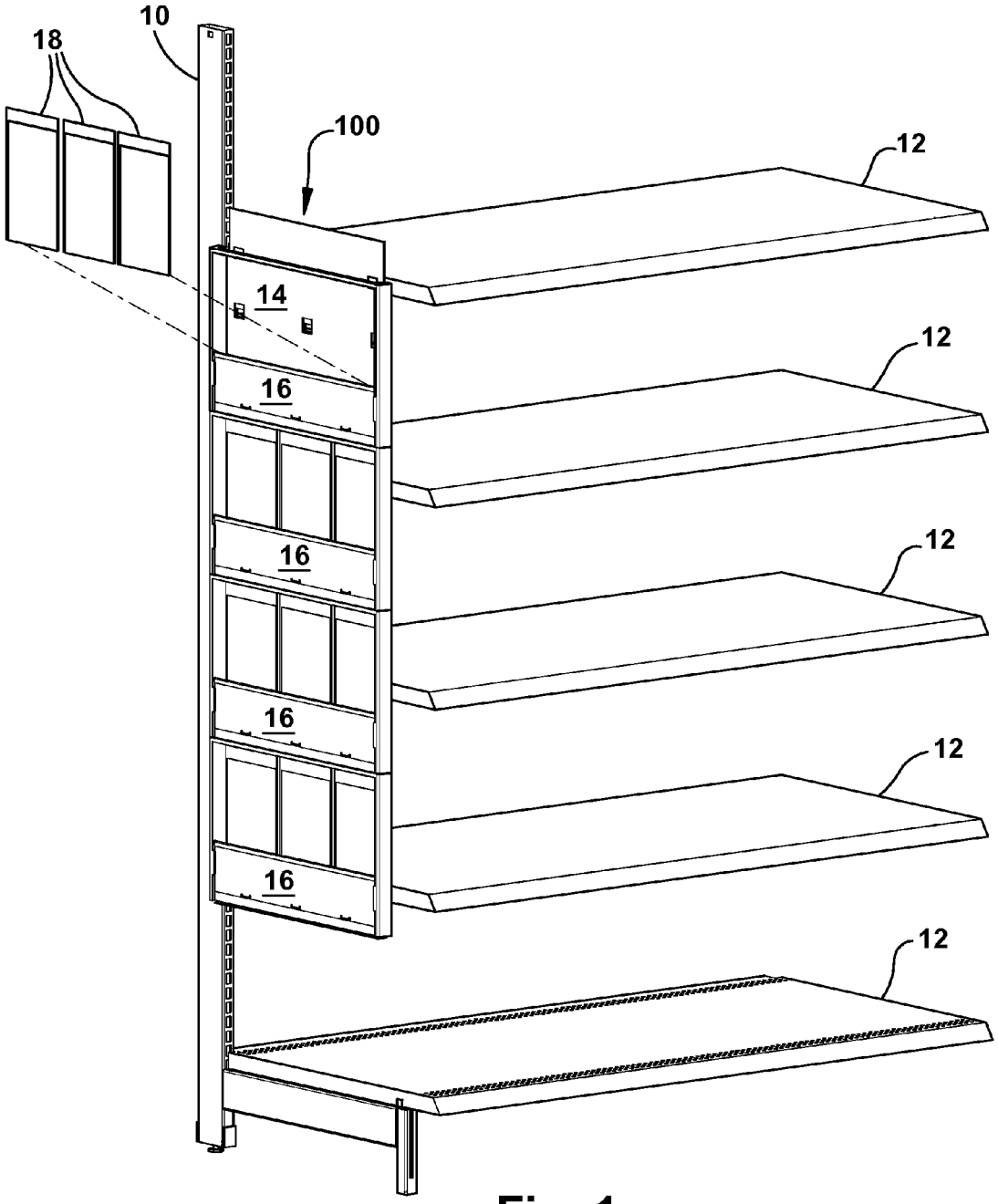
FIG. 1 is a perspective view of the GREETING CARD END CAP PANEL of the present invention, attached to the slotted uprights of an end cap display.
Figure 5:
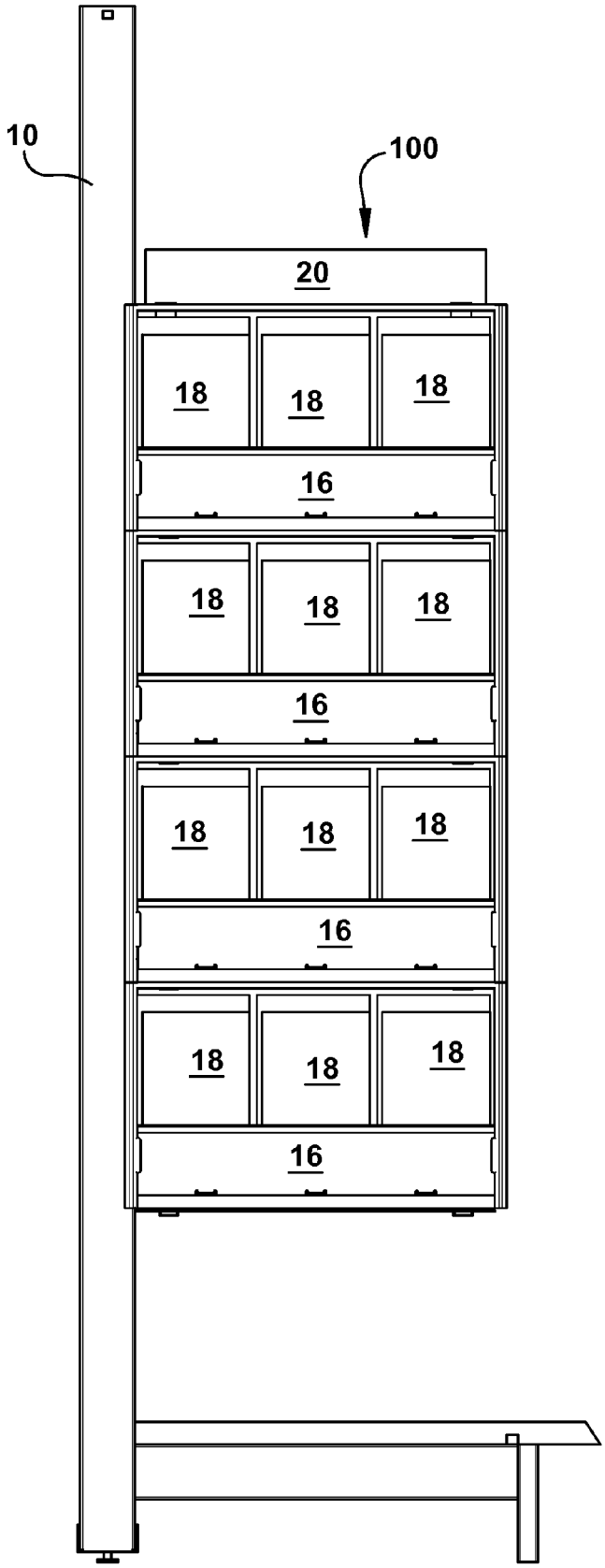
FIG. 5 is a front view of the GREETING CARD END CAP PANEL of FIG. 1, from the left side of the end cap.

As shown in FIGS. 1 and 5, an end cap panel display 100 of the present invention with four (4) panel trays 14 connected to a slotted upright 10, can contain and display up to twelve (12) groups of greeting cards 18 in a front facing manner, with essentially the entire front cover of each group of greeting cards 18 visible by a consumer. Taking into consideration the height of a typical gondola, the card end cap panel 100 of the present invention can have a maximum of six (6) panel trays 14 attached together, which makes the maximum number of greeting card groups 18 contained on the display 100, eighteen (18). If the end cap display panel 100 were used on both sides of an end cap shelf, then the display panel 100 could display up to thirty-six (36) groups of greeting cards, and if the end cap display panel 100 were used on both sides of end cap shelving on opposing ends of a gondola, then the display panel 100 could display up to seventy-two (72) groups of greeting cards.

One or more divider tabs (not shown) may be attached to the pocket front 16 to divide the greeting card pocket into separate compartments or pockets. As shown in FIGS. 1 and 5, each panel tray 14 is wide enough to display up to three (3) groups of greeting cards 18, arranged side-by-side in a front facing manner. In this case, two divider clips may be attached to the pocket front to divider the panel tray 14 into three (3) separate pockets.

As mentioned above, two (2) sign clips 22 can be inserted into the empty or unused panel engagement slots 14D of the uppermost panel tray 14. Each sign clip 22 contains a channel therein for the insertion of signs or messaging at the top of the end cap panel display 100, as shown in FIGS. 2 and 4.

The card end cap display panel of the present invention provides a unique fixture for utilizing previously unused retail space on an end cap for the display of up to seventy-two (72) different groups of greeting cards. The greeting cards are arranged in a front facing manner that provides complete or substantial visibility to the front cover of each greeting card group. The display 100 allows for the minimization of floor space allowing for the maximization of product at display in a retail environment. The display 100 is relatively thin and is also prevented from swaying outward from the end cap and interfering with critical aisle space.

While the end cap panel display of the present invention has been described herein and shown in the figures as being a display for greeting cards, it can also be used for other merchandise displayed at retail. Embodiments disclosed herein are intended as examples to clearly convey the invention and are not meant to limit the invention in any way. Different numbers of attachment and securement slots, tabs and channels have been contemplated and are considered to be within the scope of the invention. The end cap panel may also attach to other types of retail display structures and may be modified to fit such structures. The sizes and materials identified herein with regard to the invention are intended as preferred or exemplary sizes and materials and other sizes and materials have been contemplated and are considered to be with the scope of the present invention.

The invention claimed is:

1. An end cap panel comprising:

at least two trays which are removably attached directly to one another, each of the at least two trays being operative to contain at least one group of stacked greeting cards therein;

a mounting bracket which is removably attached to at least one of the at least two trays, the mounting bracket operative to be inserted into one or more slots of a slotted upright alongside an end cap shelf which is also attached to the same slotted upright;

wherein the end cap shelf and the mounting bracket are attached to at least one of the same slots of the slotted upright; and wherein a front face of the at least two trays is positioned perpendicular to a front face of the end cap shelf and alongside a side edge of the shelf.

2. The endcap panel of claim 1, wherein the end cap panel is prevented from pivoting about the slotted upright.

3. The end cap panel of claim 1, wherein the shelf can be removed or reconfigured without interference from the end cap panel.

4. The end cap panel of claim 1, wherein the shelf can be removed or reconfigured without removing the end cap panel from the slotted upright.

5. The end cap panel of claim 1, wherein the end cap panel is not attached to the shelf.

6. The end cap panel of claim 1, wherein the at least two trays can each contain three different groups of stacked greeting cards.

7. The end cap panel of claim 1, wherein a tray is prevented from pivoting about one of the pair of slotted uprights.

8. The end cap panel of claim 1 further comprising a front pocket panel attached to each of the at least two trays.

9. The end cap panel of claim 1 further comprising a partial front panel attached to each of the at least two trays.

* * * * *